US010316594B2

(12) United States Patent
Shearer

(10) Patent No.: US 10,316,594 B2
(45) Date of Patent: Jun. 11, 2019

(54) DRILL ELEMENT AND ASSOCIATED EQUIPMENT AND METHODS

(71) Applicant: David Shearer, West Midlands (GB)

(72) Inventor: David Shearer, West Midlands (GB)

( * ) Notice: Subject to any disclaimer, the term of this patent is extended or adjusted under 35 U.S.C. 154(b) by 198 days.

(21) Appl. No.: 14/555,422

(22) Filed: Nov. 26, 2014

(65) Prior Publication Data

US 2015/0144360 A1 May 28, 2015

(30) Foreign Application Priority Data

Nov. 27, 2013 (GB) ..... 1320961.4

(51) Int. Cl.

| | |
|---|---|
| ***E21B 17/10*** | (2006.01) |
| ***E21B 21/12*** | (2006.01) |
| ***E21B 17/18*** | (2006.01) |
| ***E21B 21/08*** | (2006.01) |

(52) U.S. Cl.

CPC ..... *E21B 17/1078* (2013.01); *E21B 17/18* (2013.01); *E21B 21/08* (2013.01); *E21B 21/12* (2013.01)

(58) Field of Classification Search

CPC ..... E21B 17/18; E21B 17/1078; E21B 21/12; E21B 21/103

See application file for complete search history.

(56) References Cited

U.S. PATENT DOCUMENTS

2004/0211597 A1* 10/2004 Cravatte ..... E21B 10/322 175/57
2005/0257934 A1* 11/2005 Baird ..... E21B 10/26 166/380
2008/0087433 A1* 4/2008 Mashburn ..... E21B 21/002 166/311
2009/0272580 A1* 11/2009 Dolman ..... E21B 21/003 175/48
2010/0300761 A1 12/2010 Earles et al.
2013/0248181 A1* 9/2013 Getzlaf ..... E21B 21/103 166/285

OTHER PUBLICATIONS

"UK Search Report", GB1320961.4, dated May 6, 2014.

* cited by examiner

*Primary Examiner* — Giovanna C Wright
*Assistant Examiner* — Manuel C Portocarrero
(74) *Attorney, Agent, or Firm* — Greenberg Traurig, LLP

(57) ABSTRACT

A drill string element for use in the drilling of a borehole, the drill string element comprising: a main body; and a flow control mechanism, wherein the drill string element defines a first aperture, another aperture and a passage configured to provide a fluid flow path between the first aperture and the other aperture, the first and other apertures provide fluid communication between a volume around the drill string element and the passage, and the flow control mechanism is configured to inhibit the flow of fluid through the passage in a first operating mode and to permit the flow of fluid through the passage in a second operating mode.

20 Claims, 12 Drawing Sheets

DRILL ELEMENT AND ASSOCIATED EQUIPMENT AND METHODS

CROSS-REFERENCE TO RELATED APPLICATION

This application claims priority to United Kingdom application GB 1320961.4, filed Nov. 27, 2013and entitled "A drill string stabiliser and associated equipment and methods", which is hereby incorporated by reference.

BACKGROUND a. Technical Field

Embodiments of the present invention relate to a drill string element such as a drill string stabiliser, and an associated bottom hole assembly, drill string, rig which may be for the drilling of an oil or gas well, method of retrofitting, computer program, and non-transitory computer readable medium.

b. Background Art

In the drilling of a wellbore for an oil or a gas well a drill bit, located at a remote end of a drill pipe (or 'drill string'), is rotated to cut the wellbore through the ground.

Conventionally, rotation of the drill bit may be driven, in part, by a 'mud motor' which is located above the drill bit and which forms part of the drill string. The mud motor receives drilling fluid (commonly known as 'mud') which is delivered from the surface through the drill pipe. Movement of the drilling fluid is converted into rotational movement of the drill bit by a suitable mechanism—such as a helical flow path for the fluid through the mud motor which imparts a rotational force on a part of the mud motor which is coupled to the drill bit.

The drilling fluid is passed towards the drill bit through the drill string and leaves the drill string towards remote end thereof (normally at the drill bit). The drill fluid is, therefore, expelled into the wellbore. The fluid then travels up the wellbore, around the drill string, to the surface (as a result of more drilling fluid being pumped down the drill string at the surface to drive further rotation of the drill bit).

As is understood in the art, the drilling fluid also serves other purposes including lubrication and the transportation of cut material from the remote end of the wellbore to the surface.

The mud motor is, as will be appreciated, a form of 'downhole motor' in that the motor is part of the drill string which is located within the wellbore during use. Such motors include, for example, turbine motors (in which the fluid passes over a series of turbine blades to drive rotational movement) and positive displacement motors (in which a rotor and stator are cooperatively shaped such that the fluid pumped through the motor will cause rotation of the rotor with respect to the stator).

In conventional systems, the drill bit is rotated from the proximal end of the drill string (i.e. generally at or towards the ground surface)—such systems may or may not include a mud motor as well. Accordingly, the system may include one or more motors (which may be electrically powered motors) which are supported above or on the ground surface and which are mechanically coupled to the drill string. Such a system may be a top drive system in which the or each motor is suspended above the drill string and is mechanically coupled thereto. Such a system may, alternatively, be a rotary table based system in which the rotation of the drill string is driven by a rotary table which is located generally adjacent the wellbore substantially at the ground surface level (but potentially spaced apart from the ground surface by one or more other components of the system).

There is a need to keep the drill string in the desired position within the wellbore during the drilling operation so that the drill bit acts on the ground to cut the wellbore in the desired direction. Often this entails keeping the drill string centralised within the wellbore.

One or more stabilisers are provided as part of the drill string to space the drill string from a wall of the wellbore to keep the drill string in the desired position within the wellbore. These one or more stabilisers may also be used with rotary steerable tools in which a part of the drill string is spaced from the wall of the wellbore but the drill bit itself may be steerable towards the wall of the wellbore.

The stabilisers may take many different forms but typically comprise members which extend radially from the drill string towards the wellbore wall such that they contact the wellbore wall to restrict lateral movement of the drill string within the wellbore.

The drill string must be allowed axial movement, so that the drilling operation is not substantively impeded by the stabilisers, and the stabilisers must allow the flow of drilling fluid between the drill string and the wellbore wall to the surface.

Parts of the wellbore which do not have a casing (i.e. tubing which is typically cemented in place along the wellbore to separate the ground at the wellbore wall from the inside of the wellbore) are known as 'open holes'.

The ground at the wellbore wall in an open hole is stabilised, in part, by the drilling fluid which passes between the wellbore wall and the drill string as it travels up the wellbore. This mud exerts a force against the wellbore wall to resist collapse of parts of the wellbore wall into the open hole of the wellbore. In addition, the fluid in the drilling fluid may, in places in which the ground is permeable for example, pass into the ground leaving behind an accumulation of 'mud' from the drilling fluid. This mud or filter cake forms a thin layer on the wellbore wall which aids in stabilisation of the wellbore.

Nevertheless, parts of the ground of the wellbore may partially collapse into the wellbore and may be carried by the drilling fluid up the wellbore along with cuttings excavated by the drill bit from the remote end of the wellbore.

To allow the passage of drilling fluid past, the stabilisers typically include elongate members which extend along a length of the drill string (as well as radially). Each such member is separated from its neighbouring member to allow the passage of drilling fluid between the members.

If there is an accumulation of debris adjacent the stabilisers, however, this can impede or even prevent axial movement of the drill string with respect to the wellbore. Such an accumulation may occur as a result of material from the ground collapsing into the wellbore and/or as a result of the cuttings from the action of the drill bit. The situation may be exasperated by the poor selection of an appropriate form of drilling fluid for the ground through which the wellbore is being drilled.

In some wellbores the ground surrounding part of the wellbore may swell (e.g. as a result of absorption of the drilling fluid). In addition, these and other materials in the ground may be pressed into the wellbore by the weight of the surrounding material—thus increasing the quantity of debris in the wellbore. Splintering of material from the wall of the wellbore may also occur as a result of over-pressured formations in the ground surrounding the wellbore, poor selection of drilling fluid, the absorption of drilling fluid by surrounding materials, and the like.

This is generally known a 'packing off' and commonly occurs in the region of the stabilisers (as the debris is packed between the drill string and the wellbore wall and inhibited from being removed by the stabilisers of the drill string).

The packing off of the drill string may cause the drill string to become stuck. This prevents removal of the drill string from the wellbore and/or continued drilling of the wellbore.

The drilling fluid, in such a situation, is often trapped and prevented from moving past one or more stabilisers by the debris. As such, any axial movement of the drill string (and hence the stabilisers which form a part of that drill string) requires the drilling fluid to be compressed or extended. This creates a hydraulic locking action which further inhibits axial movement of the drill string within the wellbore. In such events, rotation of the drill string may also be inhibited or substantially prevented—as a result of a number of different factors including increased friction at the drill bit and/or stabilisers (or elsewhere along the drill string) due to the delivery of drilling fluid being terminated (to prevent excessive fluid pressures) and/or the compression of material between the drill string and the wall of the wellbore at the site of the packing off.

A stuck drill string may be difficult (or potentially impossible) to remove. The time taken to remove a stuck drill string also results in significant extra costs.

The same problems also apply to other boreholes and the use of other drill string elements.

There is a need, therefore, to provide mechanisms and methods by which stuck drill strings can be more readily removed from boreholes.

Accordingly, the present invention seeks to ameliorate one or more problems associated with the prior art.

The foregoing discussion is intended only to illustrate the present field and should not be taken as a disavowal of claim scope.

SUMMARY

An aspect of the present invention provides a drill string element for use in the drilling of a borehole, the drill string element comprising: a main body; and a flow control mechanism, wherein the drill string element defines a first aperture, another aperture and a passage configured to provide a fluid flow path between the first aperture and the other aperture, the first and other apertures provide fluid communication between a volume around the drill string element and the passage, and the flow control mechanism is configured to inhibit the flow of fluid through the passage in a first operating mode and to permit the flow of fluid through the passage in a second operating mode.

The passage may be a fluid relief passage, such that the flow of fluid through the fluid relief passage is configured to provide a path for the flow of fluid which bypasses a portion of a volume between the wall of the borehole and the drill string element.

The fluid relief passage may provide a fluid flow path from a first part of the main body to a second part of the main body, the first and second parts being separated by a stabilisation member portion from which one or more stabilisation members extend.

The passage may include a cleaning fluid passage, such that the flow of fluid through the other aperture is configured to clean at least a part of the drill string element.

The drill string element may be a drill string stabiliser and the at least part of the drill string element is a part of a stabilisation member portion of the drill string element, wherein the stabilisation member portion includes the one or more stabilisation members.

The flow control mechanism may comprise at least one of a valve and a cover associated with the first and/or other aperture.

Each valve or cover may be configured to inhibit or substantially prevent the flow of fluid into the passage through the associated aperture.

The flow control mechanism may be actuated between the first and second operating modes by a fluid pressure adjacent the first and/or other aperture exceeding a threshold fluid pressure.

The flow control mechanism may comprise one or more burst discs.

The flow control mechanism may be a one-time actuatable mechanism such that the mechanism is actuatable from the first operating mode to the second operating mode, and cannot be returned to the first operating mode without replacement.

The flow control mechanism may be a multi-time actuatable mechanism such that the mechanism is actuatable from the first operating mode to the second operating mode, and can be returned to the first operating mode without replacement.

The flow control mechanism may be configured to be returned to the first operating mode without removal of the drill string element from the borehole.

The drill string element may include a further flow control mechanism and defines a further aperture and a cleaning fluid passage, wherein the further flow control mechanism may be configured to inhibit the flow of fluid through the cleaning fluid passage in a first operating mode and to permit the flow of fluid through the cleaning fluid passage in a second operating mode, and wherein the flow of fluid through the further aperture may be configured to clean at least a part of the drill string element.

The further flow control mechanism may comprise at least one of a valve and a cover associated with the further aperture.

Each valve or cover of the further flow control mechanism may be configured to inhibit or substantially prevent the flow of fluid into the cleaning fluid passage through the associated aperture.

The further flow control mechanism may be actuated between the first and second operating modes by a fluid pressure adjacent the further aperture exceeding a threshold fluid pressure.

The further flow control mechanism may comprise one or more burst discs.

The further flow control mechanism may be a one-time actuatable mechanism such that the mechanism is actuatable from the first operating mode to the second operating mode, and cannot be returned to the first operating mode without replacement.

The further flow control mechanism may be a multi-time actuatable mechanism such that the mechanism is actuatable from the first operating mode to the second operating mode, and can be returned to the first operating mode without replacement.

The further flow control mechanism may be configured to be returned to the first operating mode without removal of the drill string element from the borehole.

The drill string element may be a drill string stabiliser and the drill string element further comprises: one or more stabilisation members extending from the main body, the or each stabilisation member configured to abut a wall of the borehole.

The drill string element may further comprise a first attachment portion and a second attachment portion, the first and second attachment portions being configured for attachment to respective first and second further drill string elements.

The main body may further define a central bore.

The passage may extend from a first end to a second end of the main body.

The drill string element may include a plurality of passages between a respective plurality of first and other apertures.

The plurality of first apertures and/or the plurality of other apertures may be spaced around a circumference of the drill string element.

The passage may comprise a first passage portion and a second passage portion, wherein the first and second passage portions may be inclined at respective angles with respect to a longitudinal axis of the main body and the first and second passage portions may intersect to form at least part of the passage.

The passage may comprise a curved part.

Another aspect provides a bottom hole assembly including a drill string element.

Another aspect provides a drill string including a drill string element.

Another aspect provides a rig for the drilling of an oil or gas well, the rig including at least one drill string element.

Another aspect provides a method of retrofitting a drill string element for use in the drilling of a borehole, the method comprising: providing a drill string element having a main body; machining a passage through at least part of the drill string element, the passage providing a fluid flow path between a first aperture and another aperture; and fitting a flow control mechanism to the drill string element, the flow control mechanism being configured to inhibit the flow of fluid through the passage in a first operating mode and to permit the flow of fluid through the passage in a second operating mode.

The drill string element may be a drill string stabiliser including one or more stabilisation members extending from the main body, the or each stabilisation member being configured to abut a wall of a borehole.

Another aspect provides a non-transitory computer readable medium having stored thereon instructions which, when processed by a computing device, are configured to cause the computing device to: receive dimensions of a drill string element; receive one or more machining tool limitations representing limitations of a machining tool for machining the drill string element; define a first aperture location and another aperture location; and define a passage between the first aperture location and the other aperture location based on the dimensions of the drill string element and the one or more machining tool limitations.

The non-transitory computer readable medium may have stored thereon further instructions which, when processed by a computing device, are configured to cause the computing device to: control a machining tool to machine the defined passage in the drill string element from the first aperture to the other aperture.

The non-transitory computer readable medium may have stored thereon further instructions which, when processed by a computing device, are configured to cause the computing device to: define the first aperture location, the other aperture location, and/or passage based on the dimensions of the drill string element, the one or more machining tool limitations, and one or more flow control mechanism constraints, wherein the one or more flow control mechanism constraints define one or more requirements to permit the fixing of a flow control mechanism to the drill string element.

The non-transitory computer readable medium may have stored thereon further instructions which, when processed by a computing device, are configured to cause the computing device to: receive information about the intended use of the drill string element; and to use the received information to determine one or more attributes of a flow control mechanism and/or the passage.

The non-transitory computer readable medium wherein the drill string element may be a drill string stabiliser.

An aspect of the present invention provides a drill string stabiliser for use in the drilling of a wellbore of an oil or gas well, the drill string stabiliser comprising: a main body; one or more stabilisation members extending from the main body, the or each stabilisation member configured to abut a wall of a wellbore; and a flow control mechanism, wherein the drill string stabiliser defines a first aperture, a second aperture and a fluid relief passage configured to provide a fluid flow path between the first aperture and the second aperture, and the flow control mechanism is configured to inhibit the flow of fluid through the fluid relief passage in a first operating mode and to permit the flow of fluid through the fluid relief passage in a second operating mode.

Another aspect of the present invention provides a method of retrofitting a drill string element for use in the drilling of a wellbore of an oil or gas well, the method comprising: providing a drill string element having a main body; machining a fluid relief passage through at least part of the drill string element, the fluid relief passage providing a fluid flow path between a first aperture and a second aperture; and fitting a flow control mechanism to the drill string element, the flow control mechanism being configured to inhibit the flow of fluid through the fluid relief passage in a first operating mode and to permit the flow of fluid through the fluid relief passage in a second operating mode.

Another aspect of the present invention provides a non-transitory computer readable medium having stored thereon instructions which, when processed by a computing device, are configured to cause the computing device to: receive dimensions of a drill string element; receive one or more machining tool limitations representing limitations of a machining tool for machining the drill string element; define a first aperture location and a second aperture location; and define a fluid relief passage between the first aperture location and the second aperture location based on the dimensions of the drill string element and the one or more machining tool limitations.

BRIEF DESCRIPTION OF THE DRAWINGS

Embodiments of the present invention are described, by way of example only, with reference to the accompanying drawings, in which.

DETAILED DESCRIPTION

Figure 1:
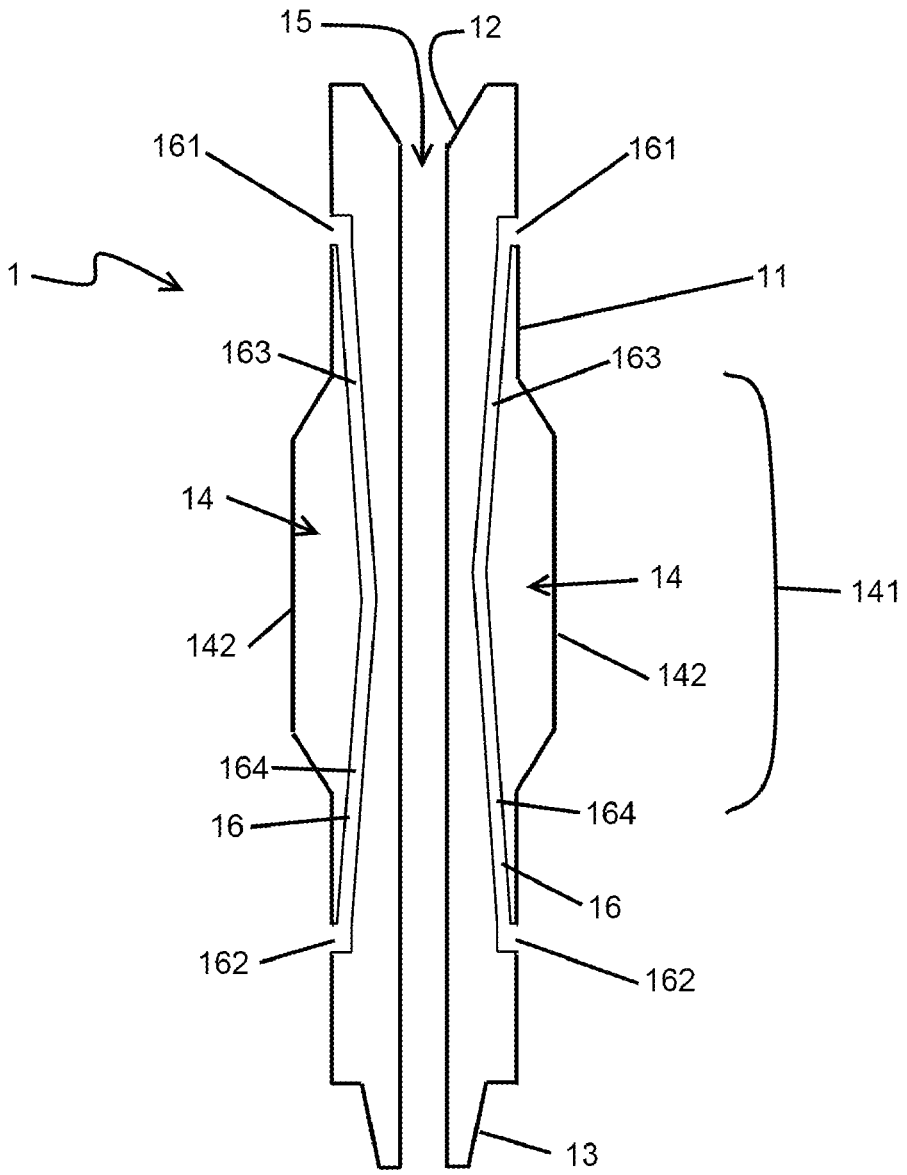
FIG. 1 shows a simplified cross-sectional view of an embodiment of a drill string stabiliser.

With reference to FIG. 1, an embodiment of the present invention comprises a drill string stabiliser 1. The drill string stabiliser 1 may be configured for use in the drilling of oil and/or gas wells or other drilling operations in which a fluid passes between a bore and a drill string 2 (see FIG. 2) such that there is a risk of hydraulic locking if the passage of the fluid is inhibited.

The drill string stabiliser 1 comprises a main body 11 which may have a generally circular cross-sectional shape. The main body 11 may be elongate and is configured for attachment to one or more elements of a drill string 2. As such, the main body 11 may include a first attachment portion 12 which is located at a first end of the main body 11. The main body 11 may further include a second attachment portion 13 at a second end of the main body 11 (the first and second ends opposing each other across a length of the main body 11).

The first attachment portion 12 (if provided) is configured to be attached to a corresponding attachment portion of a first drill string element 21 of the drill string 2 and the second attachment portion 13 (if provided) is configured to be attached to a corresponding attachment portion of a second drill string element 22 of the drill string 2. As such, the drill string stabiliser 1 may be integrated into the drill string 2 generally between the first and second drill string elements 21,22. In embodiments, the first drill string element 21 is an element which is remote from a drill bit 23 of the drill string 2 relative to the drill string stabiliser 1 and the second drill string element 22 is an element which is proximal to the drill bit 23 relative to the drill string stabiliser 1. In other words, in embodiments in which the drill string 2 is for use in drilling a generally vertical wellbore into the ground, the first drill string element 21 is above the drill string stabiliser 1 and the second drill string element 22 is below the drill string stabiliser 1.

As will be appreciated, the first and/or second drill string elements 21,22 may each include a plurality of sub-elements or components. In addition, as will be understood, the first and second drill string elements 21,22 are depicted by way of example only and the drill string 2 may include other elements not depicted.

The first attachment portion 12 may comprise a female member which carries an internal thread which is configured to cooperate with a male member of the corresponding attachment portion of the first drill string element 21 (the male member carrying an external thread). The second attachment portion 13 may comprise a male member which carries an external thread which is configured to cooperate with a female member of the corresponding attachment portion of the second drill string element 22 (the female member carrying an internal thread).

The male member (of the second attachment portion 13 and/or the first drill string element 21) may be tapered such that an external diameter of a distal end of the male member is greater than an external diameter of a proximal end of the male member. The female member (of the first attachment portion 12 and/or the second drill string element 22) may be tapered such that an internal diameter of a distal end of the female member is greater than an internal diameter of a proximal end of the female member.

The male and female members may be what is known in the art as a 'pin' and 'box' respectively.

In embodiments, the female member of the first attachment portion 12 is configured to receive and engage a male member of the same type and configuration as the male member of the second attachment portion 13. This configuration allows interchangeable elements of the drill string 2 (including the drill string stabiliser 1) to be interchanged and re-ordered with relative ease.

In some embodiments, the drill string stabiliser 1 has a first thread configuration at the first attachment portion 12 and a second thread configuration at the second attachment portion 13. The first and second thread configurations may be different from each other in terms of one or more of thread angle, major diameter, minor diameter, pitch, lead, and pitch diameter. Accordingly, in some embodiments, the drill string stabiliser 1 may be used to as a converter to allow the attachment of drill string elements 21,22 with different attachment portions compared to other drill string elements 21,22 of the same drill string 2.

The drill string stabiliser 1 may form part of a bottom hole assembly 3 of the drill string 2. The bottom hole assembly 3 may include the drill bit 23 and is generally the portion of the drill string 2 which is proximal to the drill bit 23.

The bottom hole assembly 3 may include a plurality of such drill string stabilisers 1. In some embodiments, the first and/or second drill string element 21,22 may include another such drill string stabiliser 1. The drill string 2 may include two or more drill string stabilisers 1. In some embodiments, the drill string 2 includes between one and three drill string stabilisers 1.

In some embodiments, the drill bit 23 is directly coupled to such a drill string stabiliser 1. In these (and also other) embodiments, the first and second attachment portions 12,13 may both comprise female or male members (in other words, the drill string stabiliser 1 may have two female attachment portions 12,13 or two male attachment portions 12,13).

The main body 11 of the drill string stabiliser 1 carries a plurality of stabilisation members 14. Each stabilisation member 14 extends from the main body 11 outwardly. This extension may be in a substantially radial direction. Each stabilisation member 14 may be elongate such that a first end of the stabilisation member 14 is towards the first end of the main body 11 and a second end of the stabilisation member 14 is towards a second end of the main body 11.

In some embodiments, each stabilisation member 14 extends in a helical (or other curved) arrangement around the circumference and along a length of the main body 11. In some embodiments, each stabilisation member 14 is a substantially straight member which extends along a length of the main body 11. In some embodiments, each stabilisation member 14 comprises a plurality of portions and each portion extends in a different direction around the circumference of the main body 11 with respect to at least one other such portion (e.g. in a zigzag formation).

The first end and/or the second end of each stabilisation member 14 may be bevelled (which may ease movement of the drill string stabiliser 1 through a wellbore 4 and/or which may reduce the likelihood of the drill string 2 packing off due to the accumulation of debris at the stabilisation members 14).

The stabilisation members 14 may collectively form a stabilisation member portion 141 of the drill string stabiliser 1 which may also include one or more curved surfaces which extend between the stabilisation members 14. The main body 11 of the drill string stabiliser 1 may, therefore, comprise a first part towards the first end of the main body 11 and a second part towards the second end of the main body 11, the first and second parts being separated by the stabilisation member portion 141.

The or each stabilisation member 14 may include an abutment surface 142 which is configured to abut against an inner wall of the wellbore 4 during use. The abutment surface 142 may be a substantially smooth surface or may include one or more surface formations. The abutment surface 142 may be configured to minimise friction between the drill string stabiliser 1 and the wall of the wellbore 4 (such that the abutment of the stabilisation members 14 and the wall of the wellbore 4 does not exert an excessive load on a mechanism 24 which is provided to drive rotation of the drill bit 23 during use). As will be appreciated, as part of the drill string 2, the drill string stabiliser 1 rotates within the wellbore during use (the rotation being driven by the aforementioned mechanism 24 and/or by a drive mechanism provided at or towards a proximal end of the drive string 2 (e.g. above ground)). In some embodiments, it is envisaged that the drill string stabiliser 1 will generally not rotate with respect to the wellbore 4 but that the drill string stabiliser 1 may be configured for rotation with respect to one of more other drill string elements—for example, the drill string stabiliser 1 may be mounted on a section of drill pipe and may be configured to rotate about that section of drill pipe.

As will be appreciated, each stabilisation member 14 may be a 'stabiliser blade'.

The drill string stabiliser 1 defines a central bore 15 which is configured to allow the passage of drilling fluid therethrough. The central bore 15 extends from the first end (and first attachment portion 12) to the second end (and second attachment portion 13) of the drill string stabiliser 1. The first and second attachment portions 12,13 are configured such that the central bore 15 is in fluid communication with the first and second drill string elements 21,22 (when connected thereto) and, preferably, with central bores of those drill string elements 21,22.

In some embodiments, the main body 11 of the drill string stabiliser 1 at least partially defines one or more fluid relief passages 16. The or each fluid relief passage 16 extends generally from the first end of the main body 11 towards the second end of the main body 11. The main body 11 defines a first 161 and a second 162 aperture of each fluid relief passage 16. Each fluid relief passage 16 is configured to allow the fluid to pass into the main body 11 through the first aperture 161, along a length of the passage 16 to the second aperture 162 and out of the main body 11 through the second aperture 162 (and vice versa). In some embodiments, the first aperture 161 is located in the first part of the main body 11 and the second aperture 162 is located in the second part of the main body 11.

The fluid relief passage 16 may, in some embodiments, be at least partially defined by one or more of the stabilisation members 14. In some embodiments, the first and/or second aperture 161,162 of each passage 16 is defined, at least partially, by one or more stabilisation members 14.

Accordingly, the one or more fluid relief passages 16 provide a fluid communication path through at least part of the drill string stabiliser 1. That path may traverse a part of the drill string stabiliser 1 which has the largest width or diameter. The part of the drill string stabiliser 1 which has the largest width or diameter may be the stabilisation member portion 141. The one or more fluid relief passages 16 may, therefore, provide a path for fluid around and/or through the stabilisation member portion 141 within the drill string stabiliser 1 (which may circumvent debris which has accumulated in that region).

The or each fluid relief passage 16 may comprise two intersecting passage portions 163,164. A first of the two intersecting passage portions may extend from the first aperture 161 along an axis which is inclined with respect to a longitudinal axis of the drill string stabiliser 1 towards the point of intersection—which may be within the main body 11. The second of the two intersecting passage portions may extend from the second aperture 162 along another axis which is inclined with respect to a longitudinal axis of the drill string stabiliser 1 towards the point of intersection. In some embodiments, the first and second intersecting portions 163,164 are substantially straight. In some embodiments, the first and second intersecting portions 163,164 are curved or include curved parts. In some such embodiments, the first and second intersecting portions 163,164 may each include a curved part remote from the intersection of the two portions 163,164 and a substantially straight part at the intersection of the two portions 163,164. In some embodiments, the first and second intersecting portions 163,164 form a fluid relief passage 16 with a substantially constant degree of curvature (e.g. forming an arc of a circle).

In some embodiments, the first and second passage portions 163,164 form a single passage portion which extends in a direction which is substantially parallel to the longitudinal axis of the drill string stabiliser 1 (the direction of extension may be along an axis which is, in fact, parallel to the longitudinal axis of the drill string stabiliser 1). The single passage 163,164, may be coupled in fluid communication with the first and second apertures 161,162 by respective passages which extend generally perpendicular to the longitudinal axis of the drill string stabiliser 1 (and which may extend radially).

In some embodiments, a plurality of fluid relief passages 16 is provided. In such embodiments, the respective first apertures 161 of the plurality of fluid relief passages 16 may be located at two or more different distances from the first end of the main body 11. Similarly, the respective second apertures 162 of the plurality of fluid relief passages 16 may be located at two or more different distances from the second end of the main body 11. In other words, the first apertures 161 may be staggered along a length of the main body 11 and/or the second apertures 162 may be staggered along a length of the main body 11 (the plurality of fluid relief passages 16 may include fluid relief passages of different lengths).

In some embodiments, a plurality of fluid relief passages 16 is provided and the fluid relief passages 16 are spaced around the circumference of the drill string stabiliser 1. In some embodiments this spacing is substantially even.

In some embodiments, a plurality of first apertures 161 are in fluid communication with the same fluid relief passage 16 and/or a plurality of second apertures 162 are in fluid communication with the same fluid relief passages 16. In other words, a common fluid relief passage 16 may be provided with a plurality of first and/or second apertures 161,162 to allow the flow of fluid into and out of the passage 16.

The fluid relief passage 16 or passages 16 and/or any portions thereof may be defined by substantially smooth internal walls to keep friction to a minimum and allow the fast flow of fluid therethrough. In some embodiments, the fluid relief passage 16 or passages 16 (or parts thereof) are lined or coated. The lining or coating may improve corrosion and/or wear resistance, and/or reduce the coefficient of friction of the passage or passages 16 to improve the flow of fluid therethrough. In some embodiments, the lining/coating is replaceable. In some embodiments, the lining is provided be a tube which is configured to be inserted into the fluid relief passage 16. The lining/coating may be a plastic lining/coating. The lining/coating may be a tungsten carbide based lining/coating—such as a tungsten carbide tube.

The fluid relief passage 16 or passages 16 and/or any portions thereof may have a circular cross-sectional shape.

Figure 2:
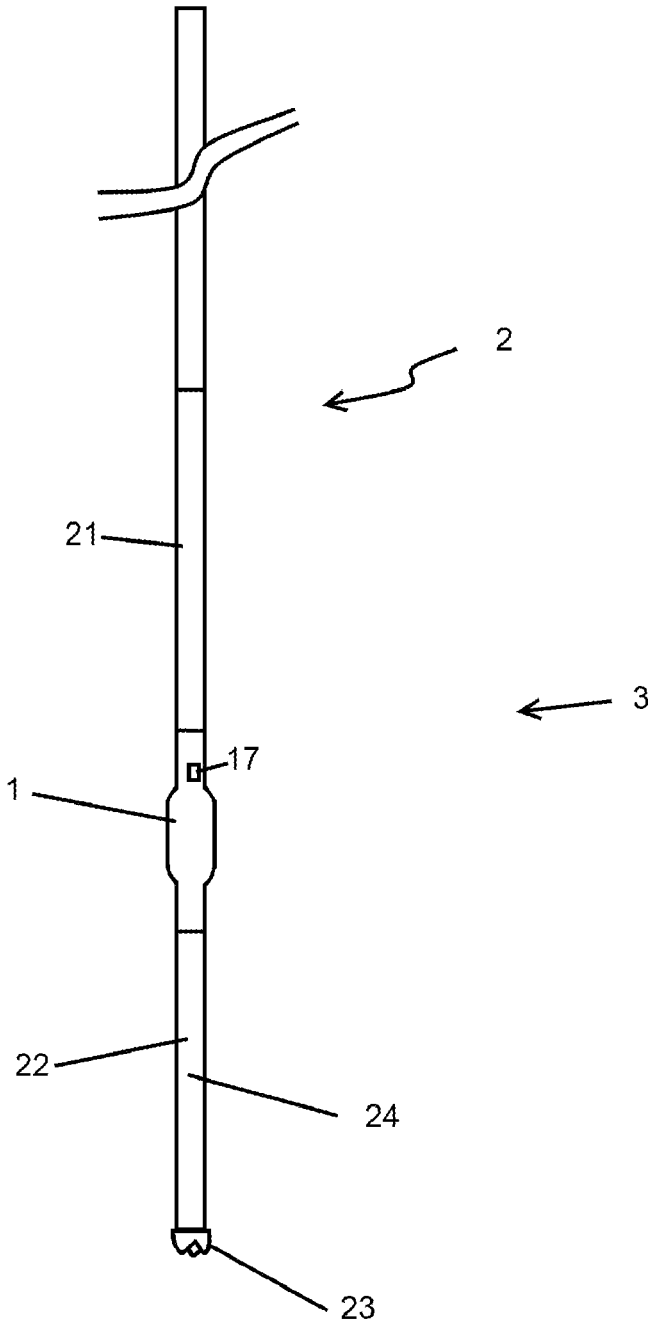
FIG. 2 shows an embodiment of a drill string including a drill string stabiliser.
Figure 3:
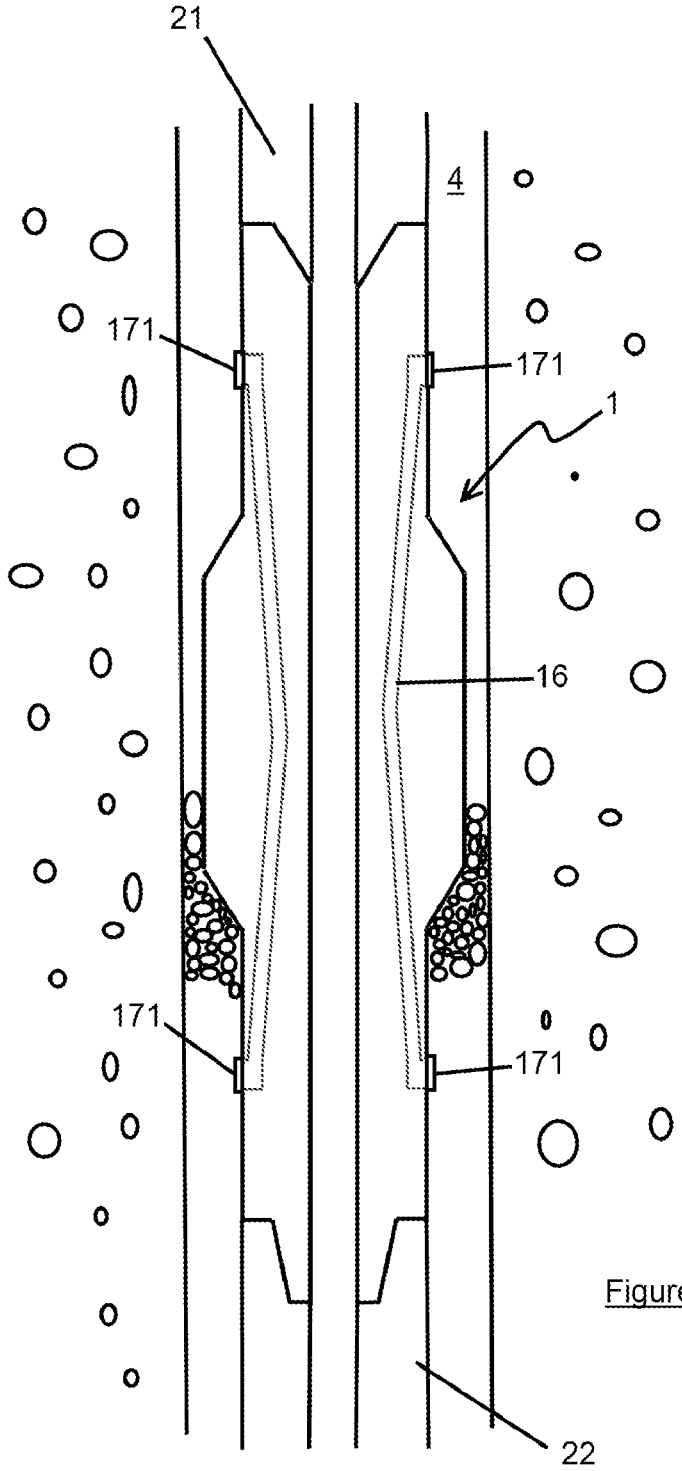
FIG. 3 shows a simplified cross-sectional view of an embodiment of a drill string stabiliser in a wellbore as a pack off event begins to occur.
Figure 4:
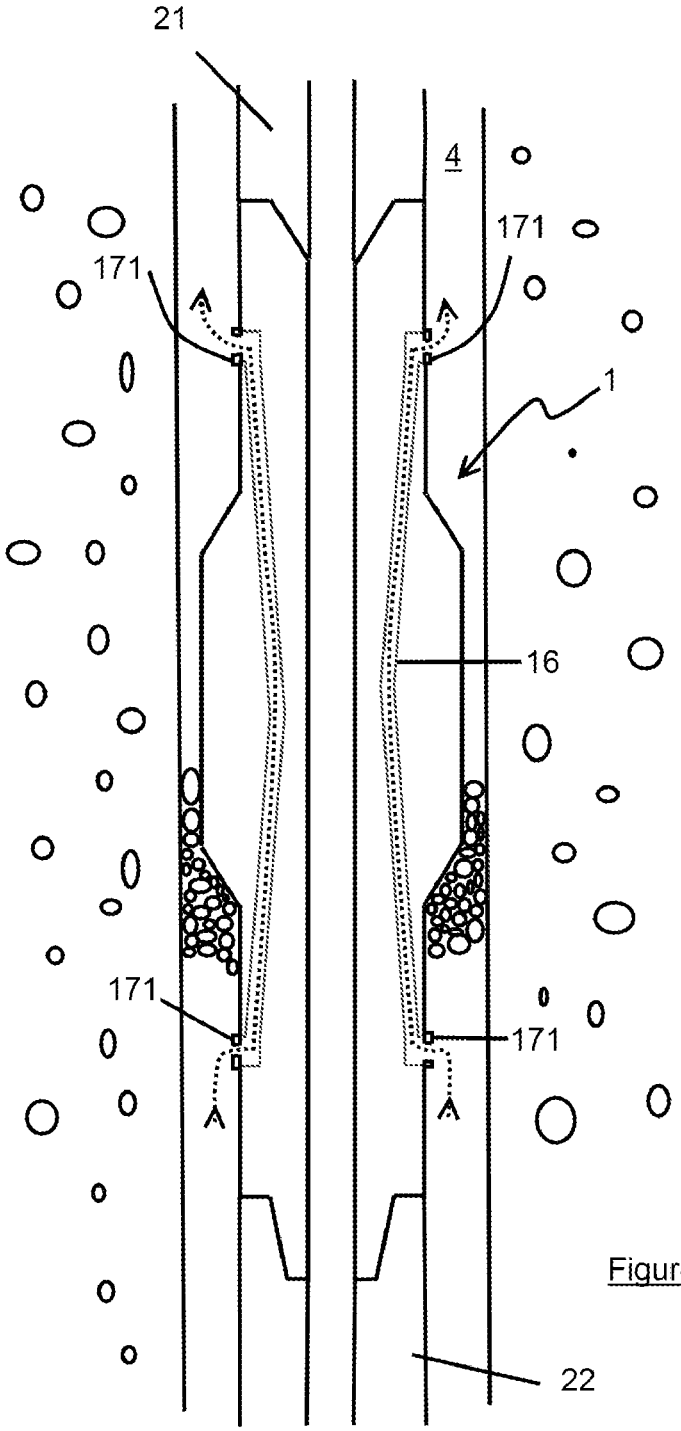
FIG. 4 shows a simplified cross-sectional view of an embodiment of a drill string stabiliser in a wellbore in a pack off event.

The or each fluid relief passage 16 may be associated with a flow control mechanism 17 which forms part of the drill string stabiliser 1 (see FIGS. 2, 3 and 4 in particular).

The flow control mechanism 17 is configured to control the flow of fluid through the associated fluid relief passage 16. The flow control mechanism 17 is configured to allow or inhibit (or substantially prevent), selectively, the flow of fluid through the associated fluid relief passage 16. As such, under normal operating conditions, the flow control mechanism 17 may inhibit or substantially prevent the flow of any fluid through the associated fluid relief passage 16 (a first operating mode). However, in the event of an abnormal operating condition—such as may be caused by packing off of the drill string 2—the flow control mechanism 17 may actuate to allow the flow of fluid through the associated fluid relief passage 16 (a second operating mode).

The abnormal operating condition may be a fluid pressure differential across a length of the drill string stabiliser 1. In a packing off event, the fluid pressure towards one end of the drill string stabiliser 1 is likely to be significantly different to the fluid pressure towards the other end of the drill string stabiliser 1. The abnormal operating condition may be a fluid pressure differential between a volume outside the fluid relief passage 16 and a fluid pressure inside the fluid relief passage 16. The fluid pressure differential may be a differential of about 3,500 kPa (500 psi).

The flow control mechanism 17 may comprise a cover or valve 171 for each aperture 161,162 associated with a fluid relief passage 16. Thus, in embodiments in which each fluid relief passage 16 has a first aperture 161 and a second aperture 162, each of these apertures may be provided with a cover or valve 171 of the flow control mechanism 17.

The valves or covers 171 are configured to inhibit the accumulation of debris in their respective fluid relief passage 16 which may block the passage 16 and/or inhibit the flow of fluid therethrough. Accordingly, the valves or covers 171 block their respective passage 16 from fluid communication with a volume around the drill string stabiliser 1 until such time as they are actuated to allow such communication.

The flow control mechanism 17 may be a mechanically operated mechanism. Thus, for example, the or each valve or cover 171 may be configured to open (to allow the passage of fluid therethrough) when it is exposed to a fluid pressure which exceeds a threshold. The threshold may be set in dependence on the expected normal operating conditions for the drive string stabiliser 1 such that the threshold is not usually exceed during normal operation but is exceeded in the event of packing off of the drive string 2.

In some embodiments, the or each valve or cover 171 is a burst disc. The or each valve or cover 171 (such as a burst disc) may be secured with respect to a respective one of the first and second apertures 161,162. The or each valve or cover 171 may be held in place by a respective clip—such as a circlip. For example, the or each valve or cover 171 may be at least partially received by the drill string stabiliser 1 (e.g. by the main body 11 near, adjacent, or within first or second apertures 161,162) and a clip may fit at least partially within a recess defined by the drill string stabiliser 1 (e.g. by the main body 11) to inhibit or substantially prevent the or each valve or cover 171 from separating from the stabiliser 1. In some embodiments, the valve or cover 171 provides a one-time operation—in that it may be actuated from the first operating mode to the second operating mode only once before requiring a manual reset or replacement. In embodiments, the valve or cover 171 comprises a flapper-type valve/cover. In some embodiments, therefore, the valve or cover 171 is operable to operate multiple times. In some embodiments, the valve or cover 171 is intended to be replaced after a predetermined period of use in a drill string 2 in a wellbore 4 (whether or not activated during that time)—i.e. preventative maintenance.

In some embodiments, the valve or cover 171 may comprise a shear pin valve.

In some embodiments, the valve or cover 171 is configured to permit a degree of 'float'. In particular, the valve or cover 171 may be configured such that an increase in fluid pressure across the valve or cover 171 will cause a part of the valve or cover 171 to move without the valve or cover 171 opening (i.e. with the valve or cover 171 remaining substantially closed). Thus, for example, an increase in the fluid pressure adjacent the valve or cover 171 but on the side remote from the pressure relief passage 16, will cause a part of the valve or cover 171 to move towards or into the fluid relief passage 16. The valve or cover 171 may, therefore, be configured to increase or decrease the fluid pressure in the fluid relief passage 16. If such a valve or cover 171 were located at either end of the fluid relief passage 16 (as in some embodiments), then an increase in fluid pressure across the valve or cover 171 associated with one end of the fluid relief passage 16 will cause movement of a part of that valve or cover 171. A fluid (which may be a substantially incompressible fluid) within the fluid relief passage 16 may transmit this movement to the valve or cover 171 at the other end of the fluid relief passage 16 to cause a movement of a part of that valve or cover 171 too.

Accordingly, the fluid pressure across a valve or cover 171 according to some embodiments of the invention may be, in part, dependent on the fluid pressure across another valve or cover 171 associated with the same fluid relief passage 16. Therefore, the fluid pressure adjacent the valve or cover 171 which will cause that valve or cover 171 to open will be dependent, at least in part, on the fluid pressure adjacent the other valve or cover 171. That pressure may be set by the use of a shear pin, for example. In some embodiments, therefore, a degree of float is permitted but a pressure differential across a valve or cover 171 which exceeds a threshold will still cause the valve or cover 171 to open.

This arrangement provides for a fluid pressure differential adjacent two different valves or covers 171 associated with the same fluid relief passage 16 be a factor in determining when, during a pack off (for example), the or each valve or cover 171 will open.

The fluid relief passage 16 may, therefore, be filled with a liquid such as oil (which is contained within the fluid relief passage 16 by the valves or covers 171). The fluid relief passage 16 may be filled with a fluid (which may be a liquid) which is under pressure (i.e. at a pressure which is greater than atmospheric pressure)—this may occur before or after the or each cover or valve 171 is attached to control the flow of fluid through the first and/or second apertures 161,162.

As will be appreciated, an operator may fit a valve or cover 171 which is configured to actuate from the first operating mode to the second operating mode based on the expected fluid pressures for that particular drilling operation.

Accordingly, in an embodiment in which a fluid relief passage 16 is provided and the first and second apertures 161,162 are associated with valves or covers 171, if the fluid pressure adjacent the second aperture 162 exceeds the threshold of the cover or valve 171 at that aperture 162, the cover or valve 171 will allow flow of fluid into the fluid relief passage 16. This will cause a corresponding increase in fluid pressure within the fluid relief passage 16 adjacent the first aperture 161 until that pressure exceeds the threshold for the cover or valve 171 at the first aperture 161. The valve or cover 171 at the first aperture 161 will, therefore, then allow the passage of fluid through the first aperture 161.

As such, in a pack off event, a passage (the or each fluid relief passage 16) is provided which allows the passage of fluid through a portion of the drill string stabiliser 1 to reduce the hydraulic locking action. This is shown in FIGS. 3 and 4. In FIG. 3 a pack off event is about to occur as debris has accumulated between the drill string stabiliser 1 and the wall of the wellbore 4. Fluid pressure in the wellbore on the side of the drill string stabiliser 1 which is towards the drill bit 23 will increase and create a hydraulic locking effect which inhibits the removal of the drill string 2 from the wellbore 4 and/or the further insertion of the drill string 2 into the wellbore 4 (the latter also being inhibited by the debris). The flow control mechanism 17 (in this case covers or valves 171) actuates to allow the flow of fluid through the fluid relief passage 16 (in this case passages 16). The flow path of the fluid through the fluid relief passage 16 (along with the actuated valves or covers 171) can be seen in FIG. 4 which includes a dashed line indicating the flow path. On other occasions, the debris builds up above the drill string stabiliser 1 with a similar locking effect exhibited (this time with the removal of the drill string 2 being further inhibited by the debris). On such occasions, the flow of fluid through the or each fluid relief passage 16 would be the opposite to that indicated in FIG. 4. On some occasions, debris may build up above and below the drill string stabiliser 1.

The two apertures 161,162 provide fluid communication between the wellbore 4 and the fluid relief passage 16 and are configured such that, in use, there is a length (a potentially packed off length) of drill string 2 between the two apertures 161,162. The apertures 161,162 and fluid relief passage 16, therefore, provide a secondary fluid communication path through a part of the drill string stabiliser 1.

In some embodiments, the flow control mechanism 17 is not provided and one or more filtration members are provided instead. In some embodiments, the first and/or second apertures 161,162 are each associated with a filtration member which is configured to inhibit the passage of relatively large material into the fluid relief passage 16 with which the apertures 161,162 are associated. As such, the or each filtration member may inhibit or substantially prevent the movement of material into the fluid relief passage 16 which is smaller than the associated aperture 161,162 but larger than a predetermined size. The or each filtration member may comprise a wire mesh which covers the associated aperture 161,162. In some embodiments, the or each filtration member comprises a bar or rod which extends across at least part of the aperture 161,162 (or a plurality of such bars or rods). The or each filtration member may, therefore, cover at least part of the aperture 161,162 with which it is associated. The use of a filtration member seeks to reduce the risk of the associated fluid relief passage 16 from becoming blocked.

In some embodiments in which one or more filtration members are provided, drilling fluid may be free to flow through the filtration member or members into and/or out of the passage 16 even when there is no packing off event occurring. In other embodiments, one or more filtration members are not provided and the apertures 161,162 are left open.

In some embodiments, the one or more filtration members are provided in addition to the flow control mechanism 17.

Figure 10:
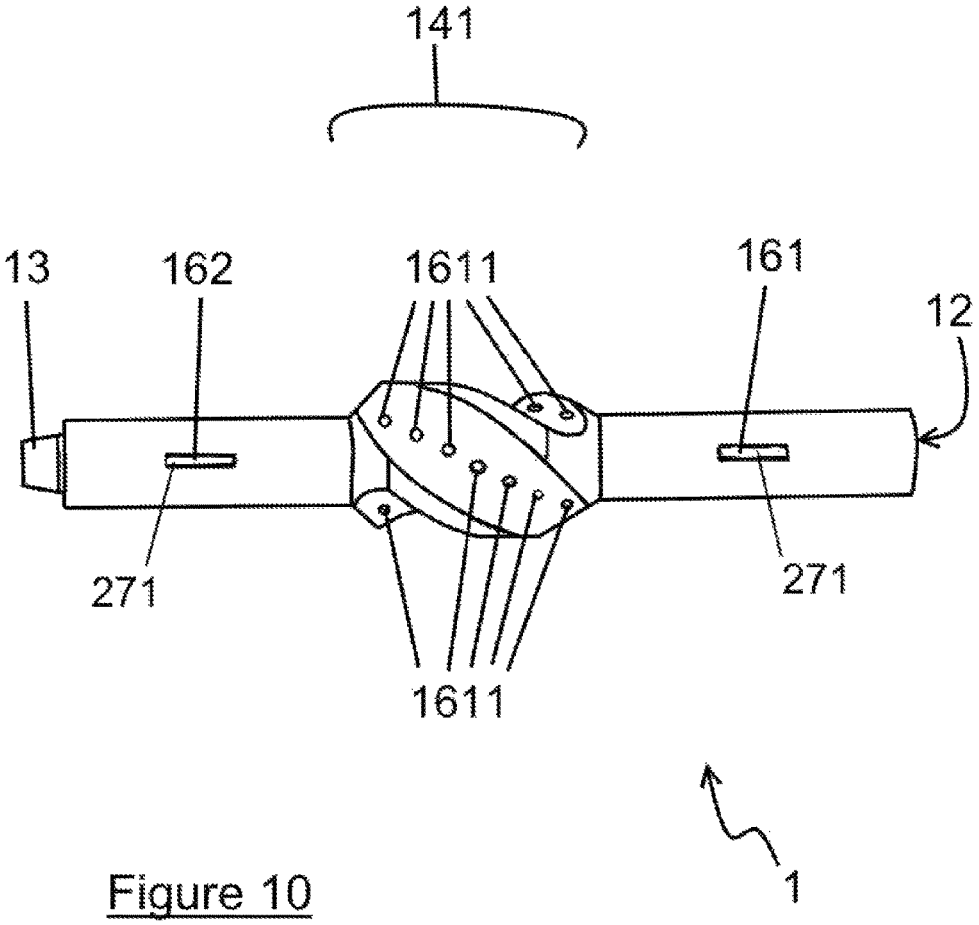
FIG. 10 shows a drill string stabiliser of an embodiment.

In some embodiments (see FIGS. 10 to 12, for example), the one or more filtration members each comprise a main member (such as a plate) 271 defining at least one weep aperture 272. In such embodiments, at least part of the flow control mechanism 17 may be mounted (or otherwise attached) to the main member 271. The flow control mechanism 17 may be configured to control the flow of fluid into and/or out of the fluid relief passage 16 through the main member 271. The main member 271 may be mounted over and/or at least partially within one of the apertures 161,162 (i.e. with respect to the first or second aperture 161/162).

The at least one weep aperture 272 provides fluid communication between a volume outside of the fluid relief passage 16 and the fluid relief passage 16. The or each weep aperture 272 may provide restricted fluid communication between the volume outside of the fluid relief passage 16 and the fluid relief passage 16 (i.e. between the wellbore 4 and the fluid relief passage 16, in use). This restricted flow may inhibit the passage of debris into the fluid relief passage 16. Thus, fluid may flow into the fluid relief passage 16 during normal operation of the drill string stabiliser 1. The flow control mechanism 17 may then operate if a pack off event occurs as discussed herein. The or each weep aperture 272, therefore, acts to allow the fluid relief passage 16 to be primed with fluid so that the flow control mechanism 17 will operate in a pack off event.

In some embodiments, main members 271 are mounted with respect to respective first and second apertures 161,162 for the same fluid relief passage 16 (i.e. at both ends of the fluid relief passage 16).

In some embodiments, the first and second apertures 161,162 may be configured to receive at least part of a respective main member 271. In some embodiments, the main member 271 is configured to fit within the first and/or second aperture 161,162 such that it substantially fills the aperture 161,162. In some embodiments, the first and/or second aperture 161,162 is configured to receive substantially all of the main member 271. In some embodiments, the main member 271, when received by the first or second aperture 161,162, will have an external surface which is substantially flush with an outer surface of the drill string stabiliser 1 adjacent the first or second aperture 161,162.

The main member 271 may be held in place by a securing arrangement which may include one or more bolts, rivets, clips, etc.

Figure 11:
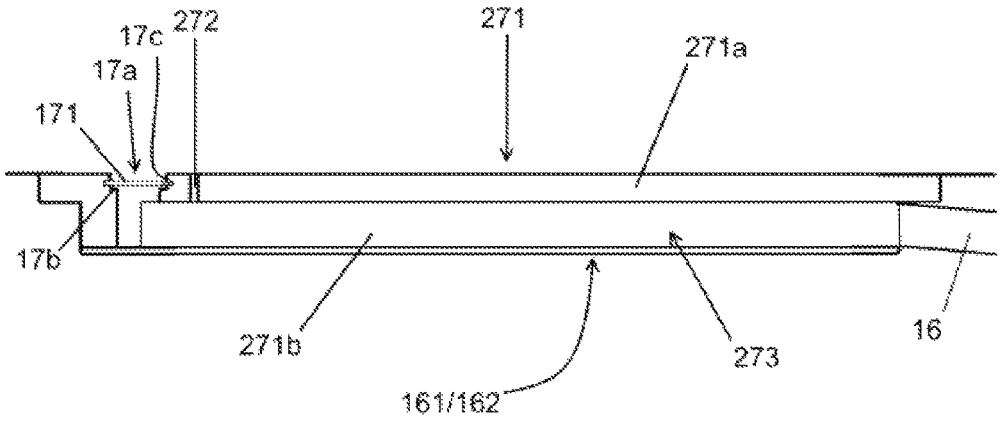
FIG. 11 shows a cross-section of a filtration member of an embodiment.
Figure 12:
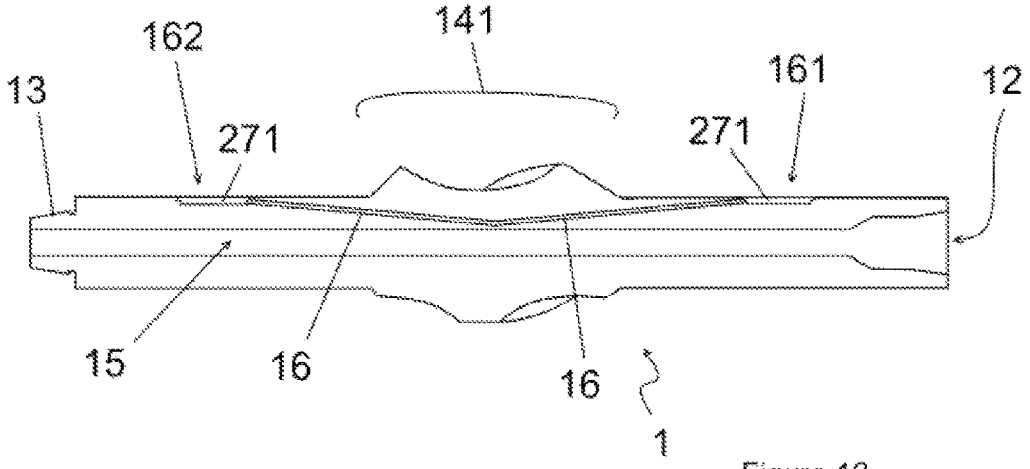
FIG. 12 shows a cross-sectional view of a drill string stabiliser of an embodiment.

An embodiment of the main member 271 is depicted in FIG. 11. In this embodiment (and others), the main member 271 includes an outer portion 271*a* and an inner portion 271*b*. The outer portion 271*a* may have a larger cross-section than the inner portion 271*a* in at least one dimension, such that the outer portion 271*a* forms a cover or plate for the inner portion 271*b*.

The main member 271 is depicted in FIG. 11 received by the first or second aperture 161,162. In this (and other) embodiments, the first or second aperture 161,162 includes a first portion which is configured (e.g. sized and shaped) to receive the outer portion 271*a* of the main member 271 and a second portion which is configured (e.g. sized and shaped) to receive the inner portion 271*b* of the main member 271.

As will be appreciated, in this (and other) embodiments, the first and/or second aperture 161/162 is in the form of a channel which is configured to receive the main member 271. The channel may be in fluid communication with the fluid relief passage 16. In particular, the second portion may be in fluid communication with the fluid relief passage 16.

The outer portion 271*a* of the main member 271 may define a main aperture 17*a* and a weep aperture 272. The flow control mechanism 17 may be provided in relation to the main aperture 17*a* and may be configured to control the flow of fluid through the main member 271 to the fluid relief passage 16. As such, the main aperture 17*a* may extend through a depth (which may be the entire depth or substantially the entire depth) of the main member 271. The main aperture 17*a* may be coupled in fluid communication with a fluid channel 273 which may be at least partially defined by the main member 271. In some embodiments, the fluid channel 273 is at least partially defined by the main body 11. In some embodiments, the fluid channel 273 passes through at least part of the inner portion 271*b* of the main member 271. The fluid channel 273 provides fluid communication between the main aperture 17*a* and the fluid relief aperture 16. In some embodiments, the weep aperture 272 extends through a depth of the outer portion 271*a* of the main member 271 and is in fluid communication with the fluid channel 273.

The weep aperture 273 may have a diameter (or width) which is smaller than the diameter (or width) of the main aperture 17*a*.

The main aperture 17*a* (e.g. towards or within the outer portion 271*a* of the main member 271) may include a section with a large diameter (or width) followed by a portion of a smaller diameter (or width) towards the inner portion 271*b* such that a seat 17*b* is defined. The seat 17*b* is configured, in some embodiments, to support at least part of the valve or cover 171. The valve or cover 171 may be configured, when seated on the seat 17*b*, to seal substantially the smaller diameter section from the larger diameter section of the main aperture 17*a*—thus inhibiting or substantially preventing the flow of the volume outside the drill string stabiliser 1 into the fluid relief passage 16.

A recess for a clip 17*c* may be provided adjacent the seat 17*b* such that a clip 17*c* may be at least partially received by the recess to hold the valve or cover 171 in place on the seat 17*b*.

The main member 271 may be removably fitted to the main body 11 such that it is possible to remove and replace the main member 271. As will be appreciated, replacement of the valve or cover 17 may also possible.

As will be appreciated, therefore, the main member 271 of the filtration member of some embodiments provides the main aperture 17*a* (the flow of fluid through which is controlled by the flow control mechanism) and the weep aperture 272 which serves to allow the flow of fluid into the fluid relief passage 16 but to inhibit the passage of debris into the fluid relief passage 16—see the above description regarding the operation of the filtration member.

In some embodiments, the drill string stabiliser 1 may include one or more further apertures 1611—see FIGS. 7 to 10. The or each further apertures 1611 may be in fluid communication with a respective fluid relief passage 16 (which may be in fluid communication with the first and/or second apertures 161/162. The or each further aperture 1611 may be in fluid communication with a respective fluid relief passage 16 via a cleaning fluid passage 16*a*. The cleaning fluid passage 16*a* may interconnect with the fluid relief passage 16 between the first and second apertures 161,162.

In embodiments, the or each further aperture 1611 is located in or near the stabilisation portion 141. For example, the or each further aperture 1611 may be located between the stabilisation members 14 which form the stabilisation member portion 141 of the drill string stabiliser 1. In some embodiments, the or each further aperture 1611 is not located through the abutment surfaces 142. In some embodiments, the or each further aperture 1611 is located between the abutment surfaces 142 of the stabilisation member portion 141.

A further valve or cover 171*a* and/or a further filtration member may be associated with the or each further aperture 1611 (such that there may be a plurality of further valves or covers 171*a* and/or further filtration members). The further valve or cover 171*a* and/or further filtration member may take the form of the valves or covers 171, or filtration members, described herein (see above). As will be appreciated, the further valve or cover 171*a* and/or further filtration member are examples of further flow control mechanisms 17*a* which may be provided in some embodiments—each further flow control mechanism 17*a* being associated with a respective further aperture 1611. The or each further flow control mechanism 17*a* is configured to control the flow of fluid through the associated further aperture 1611. The or each further flow control mechanism 17*a* may be configured to control the flow of fluid from the fluid relief passage 16 through the associated further aperture 1611 and into a volume of the bore surrounding the drill string stabiliser 1. In some embodiments, the or each further flow control mechanism 17*a* is a sub-component of the flow control mechanism 17.

The or each further flow control mechanism 17*a* is configured to allow the passage of fluid from the fluid relief passage 16 through the associated further aperture 1611 on detection of commencement of a possible abnormal operating condition—such as a packing off event. This flow of fluid may be permitted before the flow control mechanism 17 permits the flow of fluid between the first and second apertures 161,162 through the fluid relief passage 16 in the initial stages of a packing off event. This may be achieved by the further flow control mechanism 17*a* allowing the flow of fluid at a lower pressure or pressure differential than the pressure or pressure differential at which the flow control mechanism 17 allows the flow of fluid through the fluid relief passage 16. In order for the flow of fluid to occur through the further aperture 1611, one or both of the first and second apertures 161,162 may need to have been fitted with a filtration member as described above (with or without a weep aperture 272). In some embodiments, one of the first or second apertures 161,162 includes a valve or cover 171 which is configured to allow the flow of fluid therethrough when the pressure of the fluid adjacent the valve or cover 171 exceeds a threshold (or when the pressure differential across the valve or cover 171 exceeds a threshold).

The flow of fluid through the or each further aperture 1611 is configured, therefore, to provide a flow of fluid (a 'wash') around/through the stabilisation member portion 141 which is one possible location of the accumulation which may cause a pack off event. Thus, the flow of fluid may help to dislodge the accumulating material and prevent an actual packing off event from occurring.

As such, in use, when a pack off event is starting to occur the further control mechanism 17*a* may permit the flow of fluid from the first or second aperture 161/162 through the further aperture 1611 with a view to cleaning at least a part of the stabilisation member portion 141 (e.g. the space between stabilisers 14). If this is insufficient to prevent the pack of event from occurring, then the pressure differential across the stabiliser 1 will increase to the point at which the flow control mechanism 17 will allow the flow of fluid through the fluid relief passage 16 between the first and second apertures 161,162.

As will be appreciated, a plurality of further apertures 1611 may be provided. Each further aperture 1611 may be associated with one or more cleaning fluid passage 16*a*; equally, each further aperture 1611 may be one of a plurality of further apertures 1611 associated with a single cleaning fluid passage 16*a*. The or each cleaning fluid passage 16*a* may be in fluid communication with a respective fluid relief passage 16, with a plurality of fluid relief passages 16, or a single fluid relief passage 16 may be associated with a plurality of cleaning passages 16*a*—see, for example, FIGS. 7 and 8.

In embodiments with a plurality of further apertures 1611, the further flow control mechanism 17*a* or mechanisms 17*a* may be configured to permit the commencement of the flow of fluid through the further apertures 1611 in a pre-defined sequence. The predetermined sequence may be determined by the pressure of differential pressure at or across the further flow control mechanism or mechanisms 17*a* associated with the further apertures 1611. Accordingly, the further control mechanism or mechanisms 17*a* may permit the flow of fluid through a one of the further apertures 1611 towards the first or second end of the main body 11 before the flow of fluid is permitted through another of the further apertures 1611 which is towards the opposing end of the main body 11. In some embodiments, the further apertures 1611 may, accordingly, open (e.g. by the bursting of a burst disc or opening of a valve) in a sequence from towards the first end of the main body 11 towards the second end of the main body 11 (or vice versa).

In some embodiments, the flow of fluid through a first of the further apertures 1611 is permitted at a first fluid pressure or differential pressure at or across the further control mechanism 17*a* for that first further aperture 1611. The flow of fluid through a second of the further apertures 1611 is permitted at a second fluid pressure or differential pressure at or across the further control mechanism 17*a* for that second further aperture 1611, and so on. The first further aperture 1611 may be located towards the first end of the main body 11 and the second further aperture 1611 may be located towards the second end of the main body 11 relative to the first further aperture 1611 (or vice versa). The second fluid pressure or differential pressure may be higher than the first fluid pressure or differential pressure. This may be achieved by the use of burst discs with different burst pressures or through the controlled operation of valves of the further flow control mechanism(s) 17*a*, for example.

The fluid pressure may be increased during such a process, e.g. by increasing the rate at which fluid is delivered to the wellbore, to cause the sequential operation as described above. As such, some embodiments may include a pump for providing fluid to the wellbore 4 (i.e. providing the drilling fluid) and a control system for the pump which is configured to operate the pump to increase the rate at which fluid is provided by the pump to the wellbore 4. The control system may operate to increase the rate of fluid delivery in a sequence of steps which correspond with the sequence of fluid pressures or differential pressures required to cause the aforementioned sequential operation in relation to the further apertures 1611. The drill string stabiliser 1 may include one or more fluid pressure sensors which are in communication with the control system to provide feedback to the control system of a measured fluid pressure. The control system may use the feedback of the measured fluid pressure to control the operation of the pump to achieve the desired sequential operation. As will be appreciated, references to the pump providing fluid to the wellbore 4 are, in fact, references to the delivery of fluid to the drill string—that fluid typically flowing to or towards a remote end of the drill string where it flows out of the drill string and into the volume within the wellbore 4 around the drill string (and back towards a proximal end of the drill string).

The sequential operation may assist in the cleaning action in some situations. In some embodiments, only after the further flow control mechanism(s) 17*a* permit the flow of fluid through all or most of the further apertures 1611 will the flow of fluid through the other of the first or second aperture 161/162 be permitted (flow through one of the first and second apertures 161/162 already having been permitted)—by, of course, the flow control mechanism 17.

In some embodiments, the or each cleaning passage 16*a* is not connected in fluid communication with a fluid relief passage 16 but, instead, forms a separate passage to a first or second aperture 161/162. The first or second aperture 161/162 in such embodiments may not be in fluid communication with a second or first aperture 162/161 respectively. In other words, the cleaning passage 16*a* may be a direct passage from a first or second aperture 161/162 and that first or second aperture 161/162 may not also be connected with a fluid relief passage 16.

In embodiments in which a plurality of further apertures 1611 is provided the further apertures 1611 may be staggered along a length of the stabilisation member portion 141. In embodiments, the further apertures 1611 may be located at different positions around a circumference of a part of the stabilisation member portion 141. In some embodiments, the further apertures 1611 flow a spiral or helical configuration between the stabilisation members 14.

In use, the drill string stabiliser 1 may be secured to the drill string 2 and then inserted into a wellbore 4.

The or each fluid relief passage 16 and/or the cleaning fluid passage 16*a* may be formed in the drill string stabiliser 1 at the time of manufacture or may be retrofitted thereto.

In embodiments, the or each stabilisation member 14 is welded to the main body 11. As will be appreciated, in some embodiments, the drill string stabiliser 1 is formed from metal (e.g. steel) which is machined to the desired shape to form the or each stabilisation member 14.

In some embodiments, the or each fluid relief passage 16 (and/or cleaning fluid passage 16*a*) may be part of the stabilisation member 14 and the first and/or second aperture 161,162 (and/or the further aperture 1611) maybe at least partially defined by the stabilisation member 14. There is a desire, however, to position the first and second apertures 161,162 a greater distance apart along the length of the drill string stabiliser 1 (to improve the likelihood of both apertures 161,162 being clear of debris which is causing the packing off of the drill string 2).

Accordingly, in some embodiments, the or each fluid relief passage 16 (and/or the or each cleaning fluid passage 16*a*) may be drilled or cast such that it is at least partially defined by the main body 11. In some such embodiments, the first and second apertures 161,162 (and/or the further aperture 1611) are both at least partially defined by the main body 11.

In some embodiments, a method of retrofitting a drill string stabiliser 1 is provided in which dimensions of the drill string stabiliser 1 are obtained (either through measurement of the drill string stabiliser 1 or through use of recorded dimensions thereof). Entry points for a drill (or other machining tool) are located on an outer surface of the drill string stabiliser 1—preferably two entry points which will become the first and second apertures 161,162 (a third entry point may become a further aperture 1611). The paths for intersecting first and second passage portions 163,164 are then determined, and the drill string stabiliser 1 is drilled (or otherwise machined) to form the fluid relief passage 16 through the drill string stabiliser 1. Similarly, the drill string stabiliser 1 may be drilled (or otherwise machined) to form the cleaning fluid passage 16*a*). This may be repeated several times to create a plurality of such fluid relief passages 16 (and/or cleaning fluid passages 16*a*). As will be appreciated, the or each fluid relief passage 16 (and/or cleaning fluid passage 16*a*) may be cut using any suitable method or tool—including, for example, spark erosion and water cutting.

In embodiments, other arrangements of passage portions 163,164 are created to form passages for fluid communication between the two ends of the drill string stabiliser 1. In some embodiments, a drilled or machined passage may be at least partially blocked with material (e.g. solder or welded material) to define the fluid relief passage 16 (or cleaning fluid passage 16*a*) in the desired manner. For example, a groove may be cut in at least a portion of the drill string stabiliser 1 and then part of the groove may be re-filled with material (e.g. some of the material which was removed) to form the fluid relief passage 16.

In embodiments, a computer program (stored in a non-transitory computer readable medium 6—see FIG. 6) is provided which is configured to receive dimensions of a drill string stabiliser requiring retrofitting along with one or more machining tool constraints. The one or more machining tool constraints define one or more limitations of the capability of the machining tool—for example, a maximum drill depth, a range of drill angles, etc. The computer program is configured to determine one or more entry points (as set out above) and/or one or more passage portions to be machined to define one or more fluid relief passages 16 (and/or cleaning fluid passages 16*a*). The computer program may be further configured to communicate with a machining tool which is configured to perform the machining of the drill string stabiliser 1. In some embodiments, the computer program is configured to communicate with a scanning device to determine the dimensions of the drill string stabiliser requiring retrofit and/or to register the location thereof for the machining tool. In some embodiments, the defining of the entry points is also at least partially based on one or more constraints imposed by the flow control mechanism 17 or further flow control mechanism 17*a*—for example, the dimensions of a valve or cover of the flow control mechanism 17 or further flow control mechanism 17*a* which will need to be fitted to the first and/or second aperture 161,162 or further aperture 1611 at the entry points.

In some embodiments, a computer program (stored on a non-transitory computer readable medium 6) is provided which is configured to receive information about the intended use of the drill string stabiliser 1—for example, one or more of: the depth of the wellbore 4 at which the drill string stabiliser 1 will be used, the material forming the ground through which the wellbore 4 is defined (e.g. allowing determination of the likely size and/or form of the debris which is likely to be present in the wellbore 4), the type of drilling fluid being used, the rate at which the drilling fluid will be pumped into the wellbore 4, the fluid pressure of the drilling fluid at the expected location of the stabiliser 1 along the drill string 2, and the components of the drill string 2, the expected operating temperature at the stabiliser 1. The computer program may be further configured to use the information about the intended use of the drill string stabiliser 1 to determine one or more attributes of the flow control mechanism 17 (or further flow control mechanism 17*a*) and/or the fluid relief passage 16 or passages 16 (and/or the cleaning fluid passage 16*a* or passages 16*a*) and/or any associated filtration member. For example, the computer program may be configured to determine an optimal dimension for the fluid relief passage 16 or cleaning fluid passage 16*a* (e.g. a diameter and/or length), the type of flow control mechanism 17 or further flow control mechanism 17*a* to use (e.g. the type of cover or valve), and/or the form of the filtration member (if provided).

Figure 6:
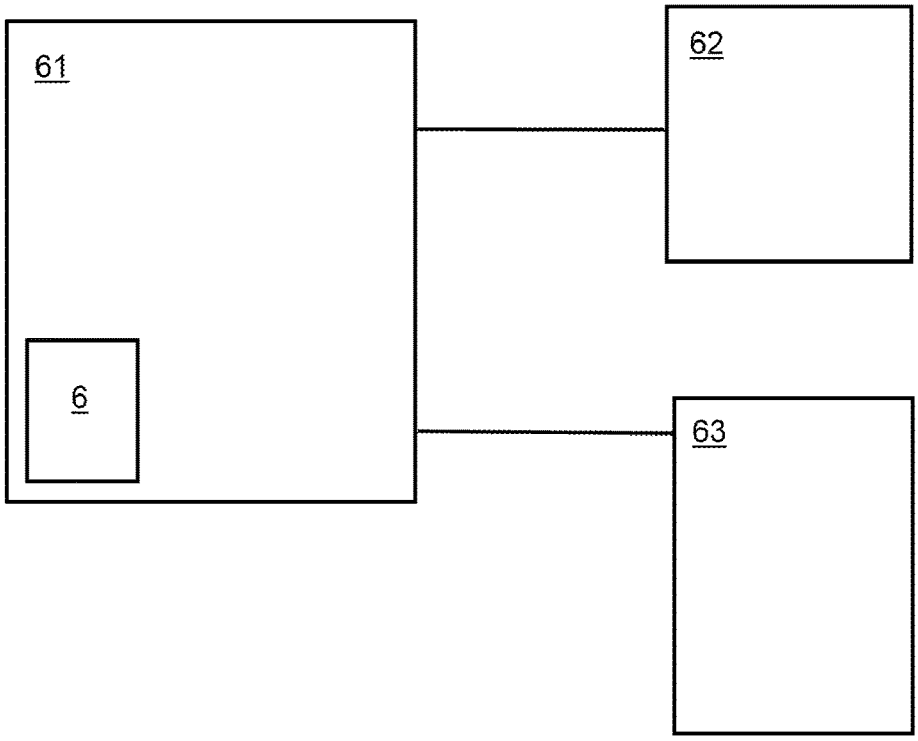
FIG. 6 shows an embodiment of a computing device.
Figure 7:
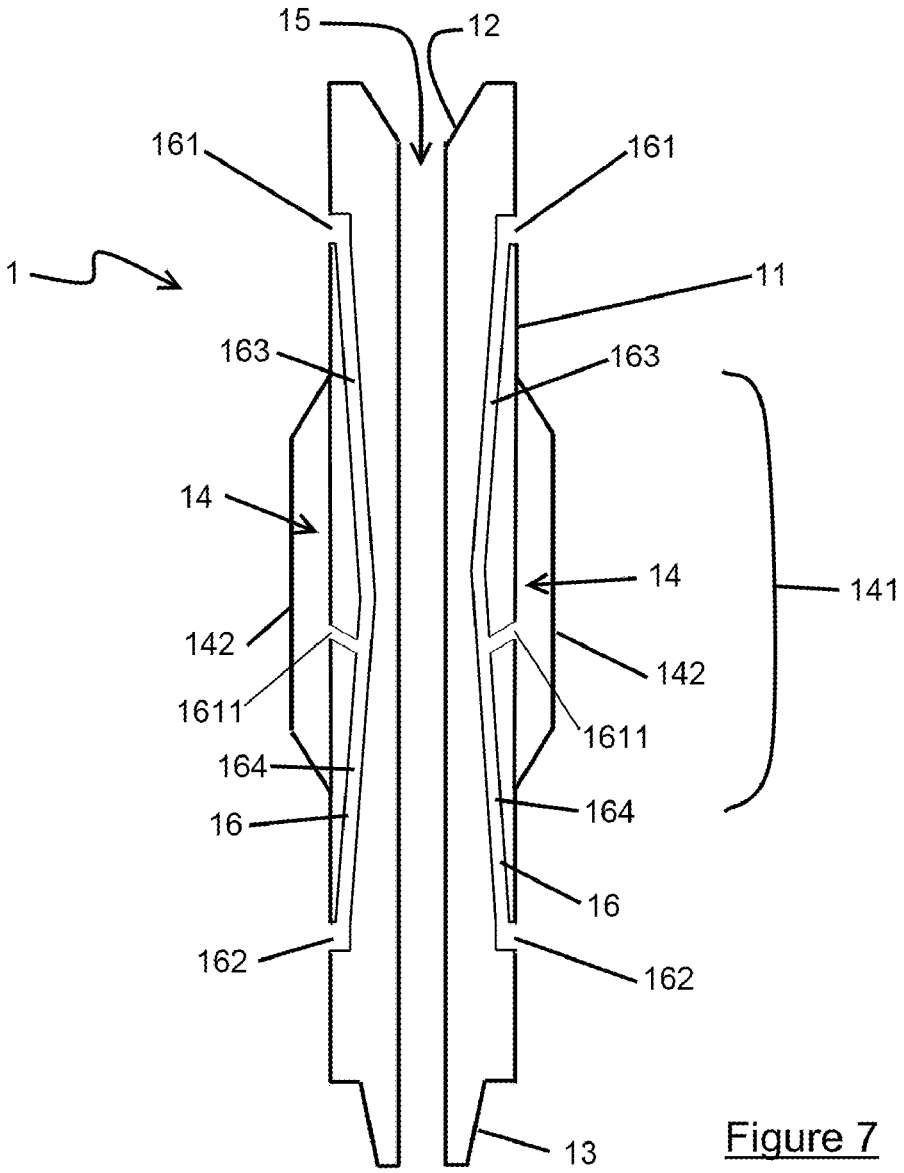
FIG. 7 shows a simplified cross-sectional view of an embodiment of a drill string stabiliser.
Figure 8:
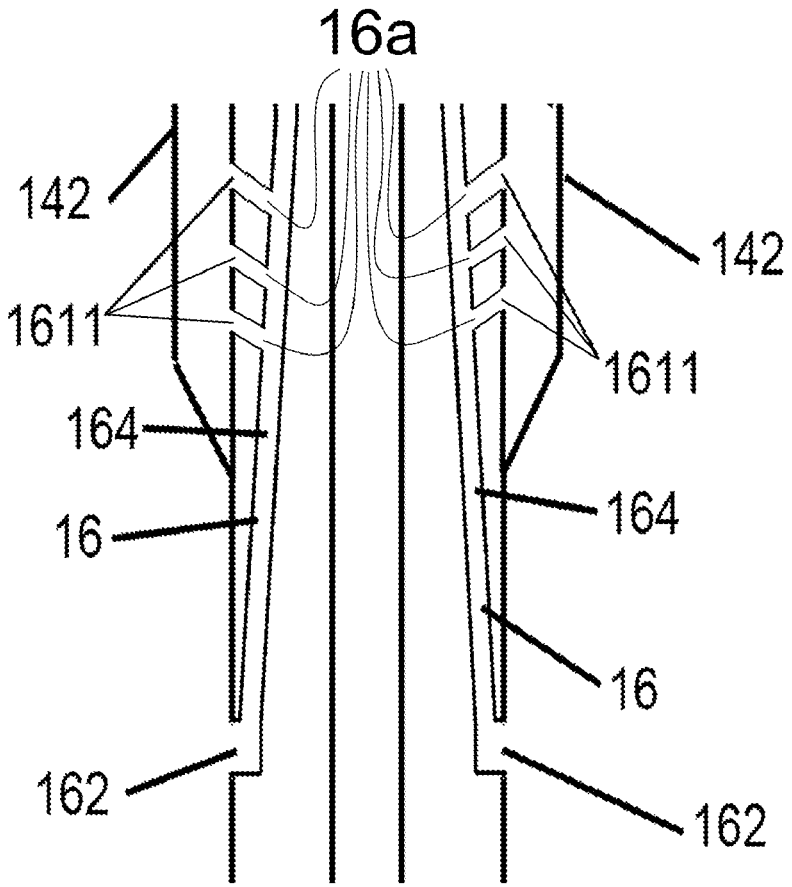
FIG. 8 shows an enlarged portion of a simplified cross-sectional view of an embodiment of a drill string stabiliser.
Figure 9:
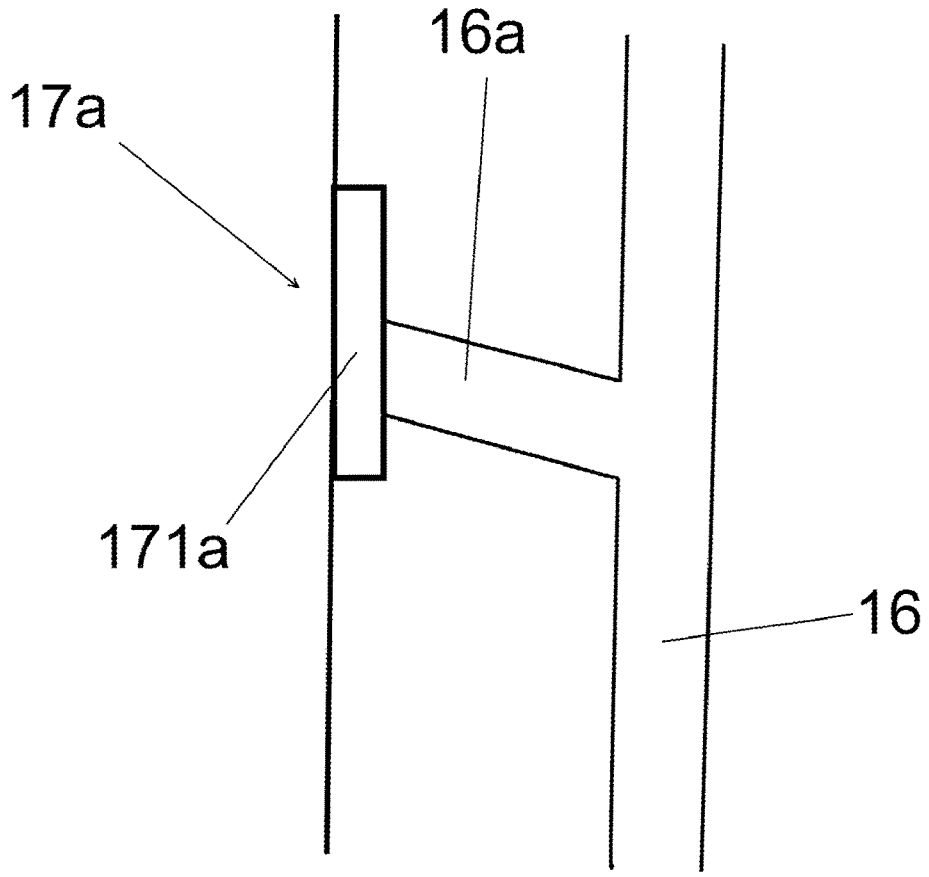
FIG. 9 shows an enlarged portion of a simplified cross-sectional view of an embodiment of a drill string stabiliser.

Embodiments of the invention (such as depicted in FIG. 6) include a computer 61 (or other computing device) configured to execute the above described computer program. Embodiments may also include the scanner 62 and/or the machining tool 63.

Figure 5:
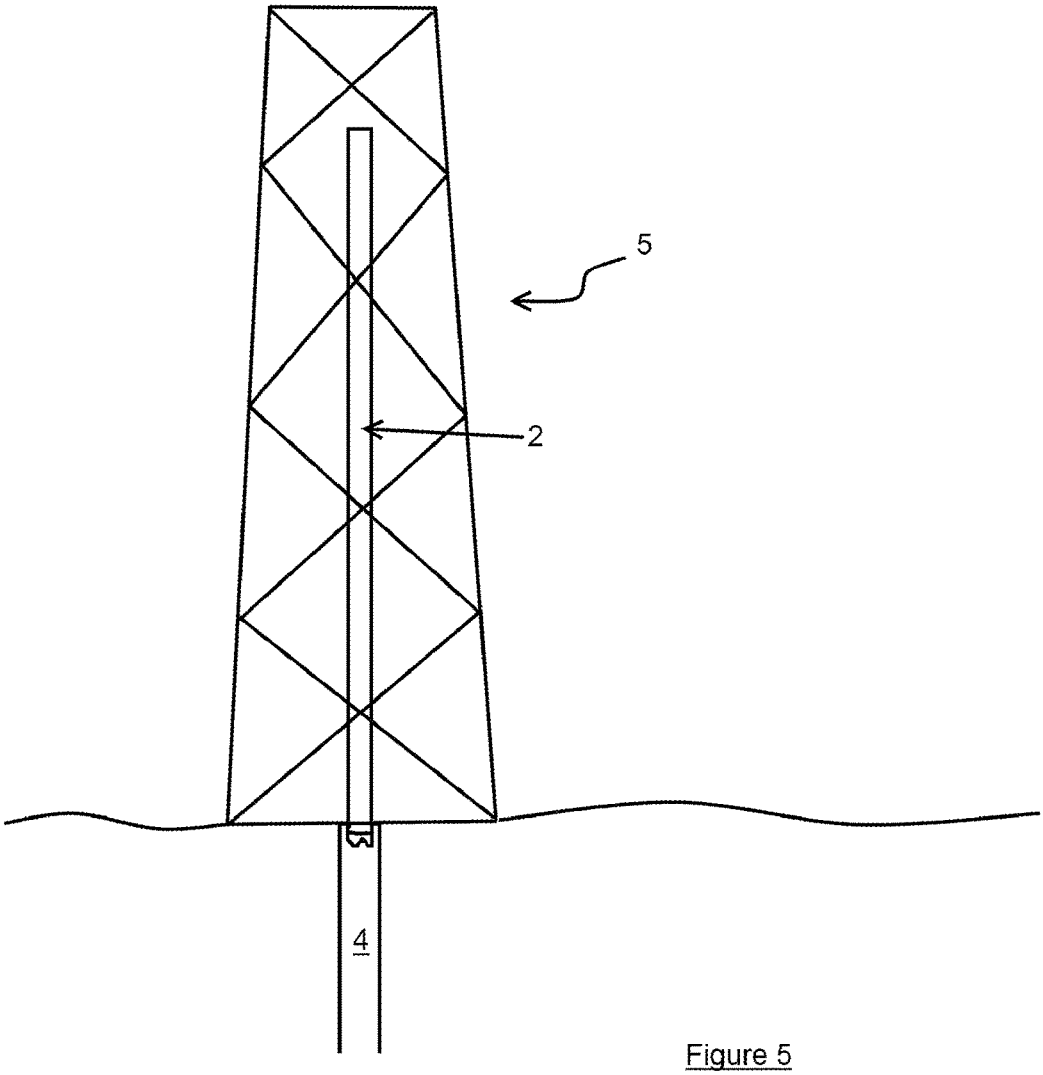
FIG. 5 shows an embodiment of a rig including a drill string stabiliser.

Embodiments of the present invention include a bottom hole assembly 3 including one or more drill string stabilisers 1. In addition, embodiments include a drill string 2 including at least one drill string stabiliser 1. The drill string 2 may include the first drill string element 21, and/or the second drill string element 22, and/or the drill bit 23, and/or the mechanism 24 to drive rotation of the drill bit 23. Embodiments may include a rig 5 (see FIG. 5) including at least one drill string stabiliser 1.

In embodiments, the mechanism 24 to drive rotation of the drill bit 23 comprises a mud motor—a mechanism for converting the flow of drilling fluid into rotation of a member which is coupled to the drill bit 23. In embodiments, the drive string 2 and/or drill bit 23 are rotationally driven from a drive mechanism which is located generally at a proximal end of the drill string 2 adjacent the wellbore 4 entrance (e.g. at or near the ground surface). This drive mechanism may include a top drive or rotary table, for example. Such a drive mechanism may be provided instead of or in addition to the mechanism 24.

In the above description it will be appreciated the fluid relief passage 16 and cleaning fluid passage 16*a* are configured to allow the passage of drilling fluid therethrough. This drilling fluid will, as it passes between the drill string 2 and the wall of the wellbore 4, typically include cutting debris and may include debris from the wall of the wellbore 4. The drilling fluid will also include one or more additives which are present in the drilling fluid which passes through the drill string 2 and will also be present in the drilling fluid as it passes back through between the drill string 2 and the wall of the wellbore 4. The drilling fluid may, therefore, include dissolved and suspended particulate matter as well as stones and pieces of rock and other material. The term 'fluid' is to be interpreted accordingly and is typically a reference to a liquid carrying one or more additives and/or debris.

The or each fluid relief passage 16 and cleaning fluid passage 16*a* does not provide a fluid flow path for fluid within the drill string 2 (fluid which is travelling through the string 2 to the mechanism 24, for example) to escape into the wellbore.

Embodiments of the invention seek to provide a drill string stabiliser 1 in which the flow of fluid through a fluid relief passage 16 in the stabiliser 1 reduces (or substantially eliminates) the hydraulic locking effect in a packing off event and/or clears debris with a view to preventing the occurrence of a packing off event. The fluid relief passage 16 seeks to allow the flow of fluid through the stabiliser 1 from a region of high pressure to a region of low pressure to achieve such an effect. The cleaning fluid passage 16*a* allows the flow of fluid across a portion of the drill string stabiliser 1, that portion being the likely location of accumulated debris which may cause a packing off event. Thus, the portion of the drill string stabiliser 1 may be cleaned in the initial stages of a packing off event and this may prevent those initial stages of a packing off event maturing into an actual packing off event.

In addition, embodiments of the invention seek to provide a drill string stabiliser 1 through which it is possible to achieve a circulation of fluid in a pack off event. Accordingly, even if the use of the drill sting stabiliser 1 of an embodiment of the invention does not allow the drill string 2 to be freed, the or each fluid relief passage 16 may allow for the circulation of drilling fluid within the wellbore 4 (i.e. from the proximal end of the drill string 2 down the drill string 2 and back up toward the proximal end). This circulation of fluid allows new forms of fluid to be circulated past (or even to) the packed off part of the wellbore 4. The new form of fluid may be drilling fluid which includes one or more components which are intended to help to free the drill string 2. For example, the new form of fluid may include an acid or other remedial fluid. Such remedial fluid may, in any event, be circulated even if the drill string 2 is freed by the operation of the invention.

In embodiments, the drill string stabiliser 1 is configured for use in vertical and/or horizontal wellbores 4. In embodiments, the drill string stabiliser 1 is configured for use in wellbores 4 which are inclined with respect to a generally vertical axis.

Some embodiments of the present invention are configured for use in relation to components of a coiled tubing system.

Embodiments of the present invention have been described with reference to a drill drilling element which comprises a drill string stabiliser 1. It will be appreciated that similar packing off may occur in relation to other drill string elements. As such, the above description also applies to other drill string elements which may or may not include one or more stabilisation members 14. In other words, the fluid relief passage 16 and the associated parts (apertures, flow control mechanism, filtration members, etc) may be implemented in relation to another element of the drill string 2 other than a drill string stabiliser 1. Equally, the cleaning fluid passage 16*a* and associated parts (further aperture, further flow control mechanism, filtration members, etc) may be implemented in relation to another element of the drill string 2 other than a drill string stabiliser 1—preferably with the or each further aperture 1611 located near or adjacent a part of that other element of the drill string 2 at which an accumulation of debris is likely to occur (with a risk of packing off as a result of that accumulation of debris).

Embodiments of the invention relate to a drill string for use in drilling a wellbore 4 of an oil or gas well. As will be appreciated, such a wellbore 4 is just one example of a borehole through a ground material (e.g. earth, rock, concrete) which may be created by such a drill string. Accordingly, embodiments include a drill string element (such as a stabiliser) which may be suitable for use in a drill string for drilling a borehole (such as a wellbore 4). The borehole may be part of an oil or gas exploration or extraction system, for example, or could be used for the extraction of water. Equally, the borehole may be used to deliver water underground (e.g. for heating and/or storage). The above described embodiments of a drill string element (such as a stabiliser 1) apply equally to a drill string element for use in a borehole for all applications.

The drill bit 23 could take many different forms—each a conventional mechanical drill bit 23 or a bit for hydrothermal spallation.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A drill string element for use in the drilling of a borehole, the drill string element comprising:

a main body having a first end and a second end opposing each other across a length of the main body; and a flow control mechanism, wherein:

the main body includes a first attachment portion at the first end and a second attachment portion at the second end, the first and second attachment portions are configured to be attached to respective other drill string elements, the drill string element defines a first aperture, a second aperture and a passage configured to provide a fluid flow path between the first aperture and the second aperture, the first and second apertures provide fluid communication between a volume around the drill string element and the passage, the flow control mechanism is configured to inhibit the flow of fluid through the passage in a first operating mode and to permit the flow of fluid through the passage in a second operating mode, the first and second apertures are separated by a portion of the length of the main body, the main body further defines a central bore that is fluidly isolated from the passage, the passage is defined by the main body and substantially located beneath a portion of the main body, and the passage comprises two intersecting passage portions defined by the main body, each passage portion extending along a respective different axes which are each inclined with respect to a longitudinal axis of the drill string element.

2. A drill string element according to claim 1, wherein the passage is a fluid relief passage, such that the flow of fluid through the fluid relief passage is configured to provide a path for the flow of fluid which bypasses a portion of a volume between the wall of the borehole and the drill string element, along the portion of the length of the main body.

3. A drill string element according to claim 2, wherein:

the fluid relief passage provides a fluid flow path from a first part of the main body to a second part of the main body, the first and second parts being separated by a stabilisation member portion from which one or more stabilisation members extend, the stabilisation member portion extends radially outwardly from the main body, and the stabilisation member includes an abutment surface spaced apart from an outer surface of the main body.

4. A drill string element according to claim 1, wherein the passage includes a cleaning fluid passage, such that the flow of fluid through the second aperture is configured to clean at least a part of the drill string element.

5. A drill string element according to claim 4, wherein the drill string element is a drill string stabiliser and the at least part of the drill string element is a part of a stabilisation member portion of the drill string element, wherein the stabilisation member portion includes the one or more stabilisation members.

6. A drill string element according to claim 1, wherein the flow control mechanism comprises at least one of a valve and a cover associated with the first aperture.

7. A drill string element according to claim 6, wherein each valve or cover is configured to inhibit or substantially prevent the flow of fluid into the passage through the associated aperture.

8. A drill string element according to claim 1, wherein the flow control mechanism is actuated between the first and second operating modes by a fluid pressure adjacent the first aperture exceeding a threshold fluid pressure.

9. A drill string element according to claim 1, wherein the flow control mechanism comprises one or more burst discs.

10. A drill string element according to claim 1, wherein the flow control mechanism is a one-time actuatable mechanism such that the mechanism is actuatable from the first operating mode to the second operating mode, and cannot be returned to the first operating mode without replacement.

11. A drill string element according to claim 1, wherein the flow control mechanism is a multi-time actuatable mechanism such that the mechanism is actuatable from the first operating mode to the second operating mode, and can be returned to the first operating mode without replacement.

12. A drill string element according to claim 11, wherein the flow control mechanism is configured to be returned to the first operating mode without removal of the drill string element from the borehole.

13. A drill string element according to claim 1, wherein the drill string element includes a further flow control mechanism and defines a further aperture and a cleaning fluid passage, wherein the further flow control mechanism is configured to inhibit the flow of fluid through the cleaning fluid passage in a first operating mode and to permit the flow of fluid through the cleaning fluid passage in a second operating mode, and wherein the flow of fluid through the further aperture is configured to clean at least a part of the drill string element.

14. A drill string element according to claim 1, wherein the drill string element is a drill string stabiliser and the drill string element further comprises:

one or more stabilisation members extending from the main body, the or each stabilisation member configured to abut a wall of the wellbore.

15. A drill string element according to claim 1, including a plurality of passages between a respective plurality of first and second apertures.

16. A drill string element according to claim 1, wherein the central bore is fluidly isolated from the passage irrespective of the operating mode of the flow control mechanism.

17. A drill string element according to claim 1, further including one or more filtration members associated with the flow control mechanism and configured to cover at least part of the first or second aperture.

18. A non-transitory computer readable medium having stored thereon instructions which, when processed by a computing device, are configured to cause the computing device to:

receive dimensions of a drill string element having a main body, the main body having a first end and a second end opposing each other across a length of the main body, the main body further including a first attachment portion at the first end and a second attachment portion at the second end, wherein the first and second attachment portions are configured to be attached to respective other drill string elements, and the main body defining a central bore that is fluidly isolated from the passage;

receive one or more machining tool limitations representing limitations of a machining tool for machining the drill string element;

define a first aperture location and a second aperture location; and define a passage between the first aperture location and the second aperture location based on the dimensions of the drill string element and the one or more machining tool limitations, the first and second aperture locations being separated by a portion of the length of the main body.

19. A non-transitory computer readable medium according to claim 18 having stored thereon further instructions which, when processed by a computing device, are configured to cause the computing device to:

control a machining tool to machine the defined passage in the drill string element from the first aperture to the second aperture.

20. A non-transitory computer readable medium according to claim 18 having stored thereon further instructions which, when processed by a computing device, are configured to cause the computing device to:

define at least one of the first aperture location, the second aperture location, and passage based on the dimensions of the drill string element, the one or more machining tool limitations, and one or more flow control mechanism constraints, wherein the one or more flow control mechanism constraints define one or more requirements to permit the fixing of a flow control mechanism to the drill string element.

* * * * *